US011827951B2

(12) United States Patent
Umlauf et al.

(10) Patent No.: US 11,827,951 B2
(45) Date of Patent: Nov. 28, 2023

(54) STEELMAKING FURNACE WITH HUMIDITY CONTROL DEVICE

(71) Applicant: ArcelorMittal, Luxembourg (LU)

(72) Inventors: William P. Umlauf, Munster, IN (US); Oscar Lanzi, III, Chicago, IL (US); Johnny C. Brannbacka, Valparaiso, IN (US); John A. Rotole, Valparaiso, IN (US); Robert Bing, Strongsville, OH (US)

(73) Assignee: ArcelorMittal, Luxembourg (LU)

( * ) Notice: Subject to any disclaimer, the term of this patent is extended or adjusted under 35 U.S.C. 154(b) by 211 days.

(21) Appl. No.: 17/414,400

(22) PCT Filed: Dec. 21, 2018

(86) PCT No.: PCT/IB2018/060491

§ 371 (c)(1),
(2) Date: Jun. 16, 2021

(87) PCT Pub. No.: WO2020/128598

PCT Pub. Date: Jun. 25, 2020

(65) Prior Publication Data

US 2022/0090230 A1 Mar. 24, 2022

(51) Int. Cl.

| | |
|---|---|
| ***C21D 9/56*** | (2006.01) |
| ***F27D 7/06*** | (2006.01) |
| ***F27D 7/02*** | (2006.01) |
| ***F27D 21/04*** | (2006.01) |
| ***F27D 19/00*** | (2006.01) |

(52) U.S. Cl.

CPC ..... *C21D 9/561* (2013.01); *F27D 7/02* (2013.01); *F27D 7/06* (2013.01); *F27D 21/04* (2013.01); *F27D 2019/0012* (2013.01); *F27D 2019/0028* (2013.01)

(58) Field of Classification Search

CPC ... F27D 21/04; F27D 7/02; F27D 7/06; F27D 2019/0012; C21D 9/561

USPC ..... 266/84

See application file for complete search history.

(56) References Cited

U.S. PATENT DOCUMENTS

| | | | | |
|---|---|---|---|---|
| 5,205,485 | A | 4/1993 | Baciu et al. | |
| 7,193,189 | B2 * | 3/2007 | Blumenthal | F27B 5/04 219/494 |
| 8,834,651 | B2 * | 9/2014 | Matsumura | C22C 38/001 148/284 |
| 9,534,270 | B2 * | 1/2017 | Fushiwaki | C23F 17/00 |

(Continued)

FOREIGN PATENT DOCUMENTS

| | | |
|---|---|---|
| CN | 105400951 A | 3/2016 |
| EP | 2871248 A1 | 5/2015 |

(Continued)

OTHER PUBLICATIONS

See Search Report of PCT/IB2018/060491 dated May 16, 2019.

*Primary Examiner* — Scott R Kastler
*Assistant Examiner* — Michael Aboagye
(74) *Attorney, Agent, or Firm* — Davidson, Davidson & Kappel, LLC

(57) ABSTRACT

A steel strip annealing furnace with a dew point control system. The furnace/control system can be more readily controlled to the desired dew point than the prior art control system and can handle the set point changes required as different types of steel coils are continuously run there-through.

4 Claims, 8 Drawing Sheets

(56) References Cited

U.S. PATENT DOCUMENTS

| | | | | |
|---|---|---|---|---|
| 11,459,631 | B2 * | 10/2022 | Takeda | C23C 2/003 |
| 2015/0140217 | A1 | 5/2015 | Takahashi et al. | |
| 2018/0051356 | A1 | 2/2018 | Takeda et al. | |

FOREIGN PATENT DOCUMENTS

| | | | |
|---|---|---|---|
| JP | H 0280511 | A | 3/1990 |
| JP | H02236229 | A | 9/1990 |
| JP | H 09256074 | A | 9/1997 |
| JP | H11241123 | A | 9/1999 |
| JP | H 11241123 | A | 9/1999 |
| JP | 2016-125131 | A | 7/2016 |

* cited by examiner

STEELMAKING FURNACE WITH HUMIDITY CONTROL DEVICE

FIELD OF THE INVENTION

The present invention relates to steel making furnaces and more particularly to furnaces for heating and soaking steel. Specifically, the invention relates to steel strip annealing furnaces and the control of the internal humidity thereof.

BACKGROUND OF THE INVENTION

In steel mills there are many different types of furnaces. In a hot dip galvanizing line, there is a section of the line for annealing the steel strip before it is dipped into the molten zinc bath. FIG. 1 is a schematic depiction of such a hot dip galvanizing line 1. The placement of the annealing furnace 2 can be seen from FIG. 1. FIG. 2 depicts the prior art annealing furnace 2 and its control structure. Typically, the annealing furnace 2 includes both a heating portion 3 and a soaking portion 4. The heating portion 3 can be a furnace such as a radiant tube heating (RTH) and the soaking portion 4 can be a radiant tube soaking furnace (RTS). Hereinafter, the prior art and the present invention will be described in terms of an RTH furnace 3 and an RTS furnace 4.

The steel strip enters the RTH 3 as shown by the arrow in FIG. 2. The strip serpentines up and down through the RTH 3 and at the end of the RTH 3, the steel strip enters the RTS 4. The strip serpentines its way up and down through the RTS 4. When the strip is finished annealing it exits the RTS 4 as shown by the arrow in FIG. 2.

It is often useful to modify and control the atmosphere and the humidity thereof in the RTH 3 and RTS 4. FIG. 2 shows a schematic depiction of a prior art system for controlling the atmosphere/humidity within the RTH 3 and the RTS 4. The atmosphere may typically be composed of $HN_x$ gas, but other atmospheric gases can be used. A supply of the atmospheric gas 5 is used to continuously supply the atmosphere to the RTH 3 and RTS 4. Further, the furnace atmosphere may be humidified by a steam generator 6. Steam generated by the generator 6 may be injected into the furnace separately but is typically mixed with the furnace atmospheric gases and then the mixture is sent into the furnace.

The humidity needs to be controlled within the RTH 3 and RTS 4. Thus, the steam generator 6 cannot be run full blast continuously. The steam input must be modulated to create the proper humidity within the furnace. Furthermore, the humidity requirements will be different for different steels that are being run through the furnaces. To accomplish the humidity control and changes due to changing steel, the furnace has a humidity control system. The prior art control system includes a steam generator controller 6' which adjusts the output of the steam generator 6. The prior art system also includes a dew point sensor 7, 9 placed at the opposite end of the furnace from the atmosphere/steam input site. This sensor detects the dew point (humidity) of the atmosphere in the furnace and transmits that measured signal 10 to a PID (proportional-integral-derivative) controller 8. The PID controller 8 includes a set point input signal 10 which corresponds to the desired furnace dew point temperature (humidity level) for the specific steel that is within the furnace at any given moment. The PID controller also receives the feedback signal 10', 11' (the measured dew point from the dew point sensor 7, 9). The PID controller creates an error signal which it combines with the set point signal 10, 11 to create a control signal 10", 11" for the steam generator controller which in turn controls the output of the steam generator.

SUMMARY OF THE INVENTION

Theoretically, this closed-loop, feed-back control system should be able to control the dew point within the RTH 3 and RTS 4. However, in practice this system is woefully inadequate for the task of controlling the dew point of the furnaces. FIG. 3 is a plot of the dew point and steam generator output vs time/coil footage running through the furnaces. When the system has a set dew point for a particular steel, there is a setpoint bar on the graph called aim dew point and the steam generator injects steam into the furnace gas (as can be seen by the Steamer Output curve). The measured dew point is shown as the RTS dew point. It is clear that the desired dew point is not being achieved by the prior art system as the dew point (and steamer output) vary significantly from the desired set point and is very oscillatory.

This is entirely unacceptable and as such, there is a need in the art for a furnace and control system that can be more readily controlled to the desired dew point and that can handle the set point changes required as different types of steel coils are continuously run therethrough.

The present invention comprises a steel strip annealing furnace with a dew point control system. The furnace/control system can be more readily controlled to the desired dew point than the prior art control system and can handle the set point changes required as different types of steel coils are continuously run therethrough.

The invention includes a furnace having an upper region and a lower region, a furnace atmosphere injector configured to inject furnace atmospheric gases into an injection region in the upper region of the furnace. The system may also includes a steam generator which may be coupled with the atmosphere injection system to mix steam into the furnace atmospheric gases. The generator may include a steam generator control unit to control the generation of steam.

The furnace system may also include a control system for controlling the steam generator to provide a desired dew point within the furnace. The control system may include an input dew point (DP) set point signal generator which generates a DP set point signal corresponding to a desired furnace DP.

The control system may further include two DP sensors which measure the local dew point and transmit a signal representative of the measured local dew point. One of the DP sensors may be an upper DP sensor positioned in the upper region of the furnace and adjacent the injection region. The other of the DP sensors may be a lower DP sensor positioned in the lower region of the furnace, remote from the injection region.

The control system may further include two proportional-integral-derivative (PID) controllers configured in a cascaded loop configuration. The control may also include three signal convertors (SC). Each SC designed to receive a DP input signal and convert it into a partial pressure of steam (PPS) output signal.

A lower of the PID controllers may be connected to a first SC, the first SC may have an input DP set point signal from the DP set point signal generator, and an output PPS set point signal which is transmitted to the lower PID controller. The lower PID controller also connected to a second SC, which may have an input lower feedback DP signal from the lower DP sensor and an output lower feedback PPS signal which is transmitted to the lower PID controller. The lower PID controller may compare the PPS set point signal and the lower feedback PPS signal to generate a lower PID error value. The error value may be added to the PPS set point signal to generate a lower PID output PPS signal.

The lower PID controller may be connected to the upper PID controller and the lower PID controller may transmit the lower PID output PPS signal to the upper PID controller. The lower PID output PPS signal becomes the upper input PPS set point signal for the upper PID controller.

The upper PID controller may also connect to a third SC. The third SC may have an input upper feedback DP signal from the upper DP sensor and an output upper feedback PPS signal which is transmitted to the upper PID controller.

The upper PID controller may compare the upper input PPS set point signal to the upper feedback PPS signal and generate an upper PID error value which may be added to the upper input PPS set point signal to generate an upper PID output signal.

The upper PID controller connected to the steam generator control uni. The upper PID controller transmits the upper PID output signal to the steam generator control unit thereby controlling the injection of steam into the furnace.

The annealing furnace with dew point control system may further include a feed forward control unit. The feed forward control unit calculates an adjustment signal to be added to the upper PID output signal. The adjustment signal to be added to the upper PID output signal is calculated based on known upcoming changes in the steel grade/chemistry, line speed, and steel strip width.

DETAILED DESCRIPTION OF THE INVENTION

The present invention is an annealing furnace for steel strip and control system that can be more readily controlled to the desired dew point and that can handle the set point changes required as different types of steel coils are continuously run therethrough.

Figure 1:
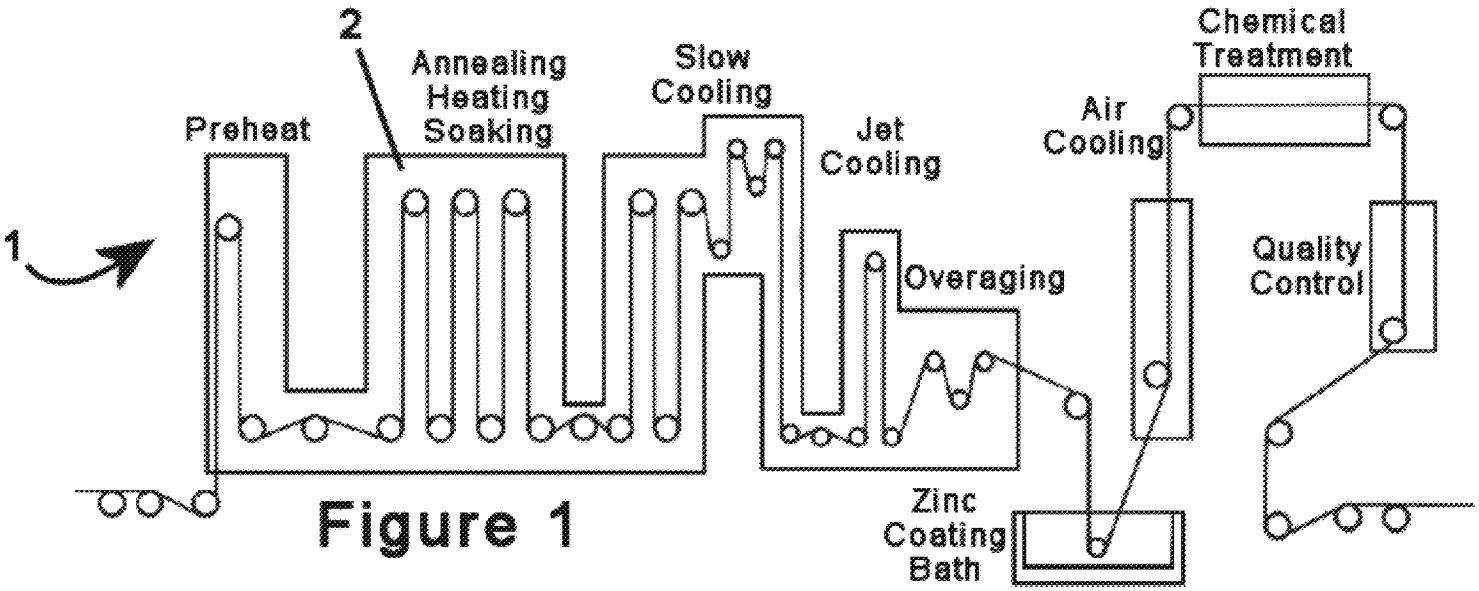
FIG. 1 is a schematic depiction of a hot dip galvanizing line.
Figure 2:
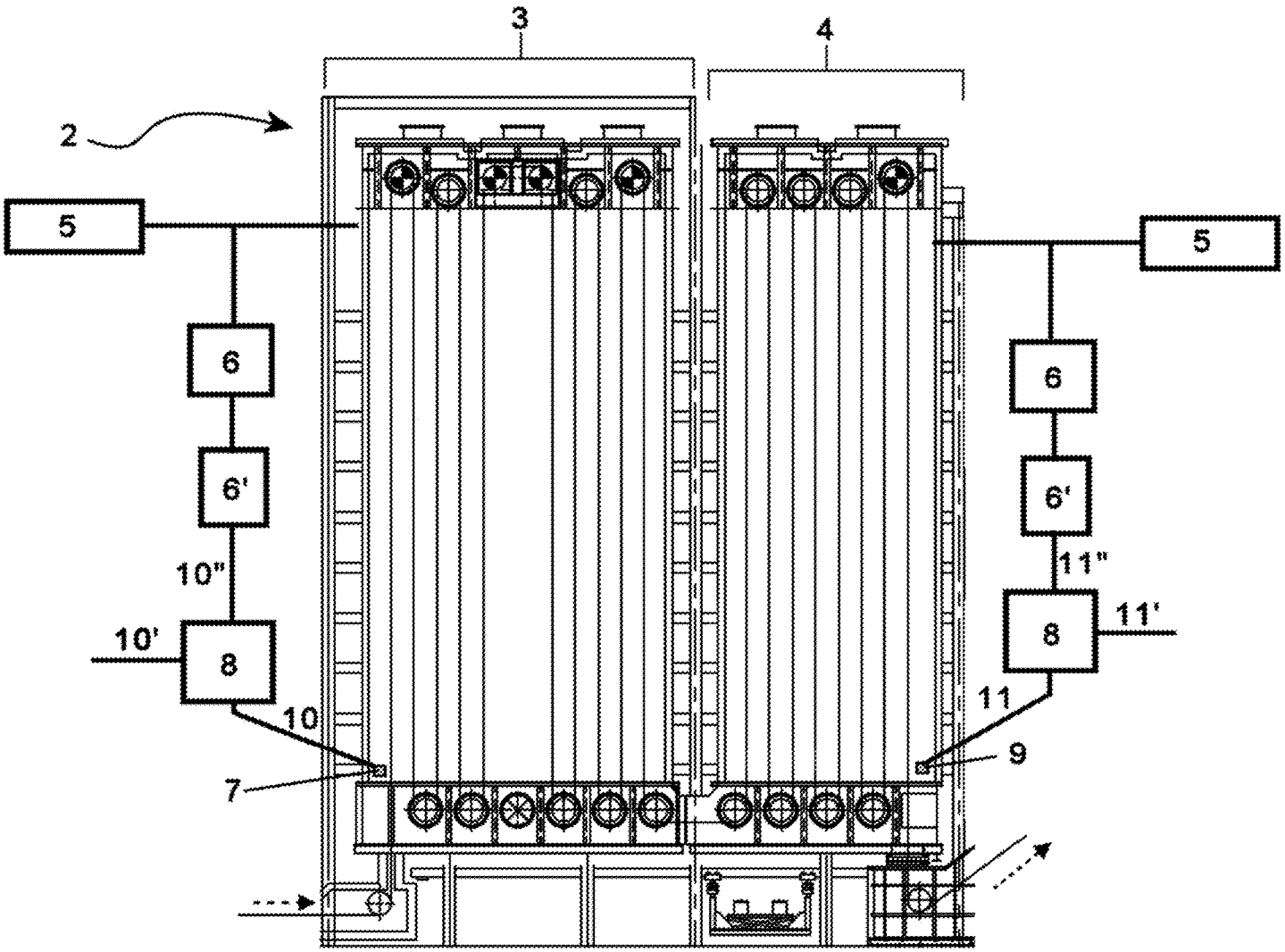
Figure 2 (prior art)
FIG. 2 is a schematic depiction of a prior art system for controlling the atmosphere/humidity within an annealing furnace.
Figure 3:
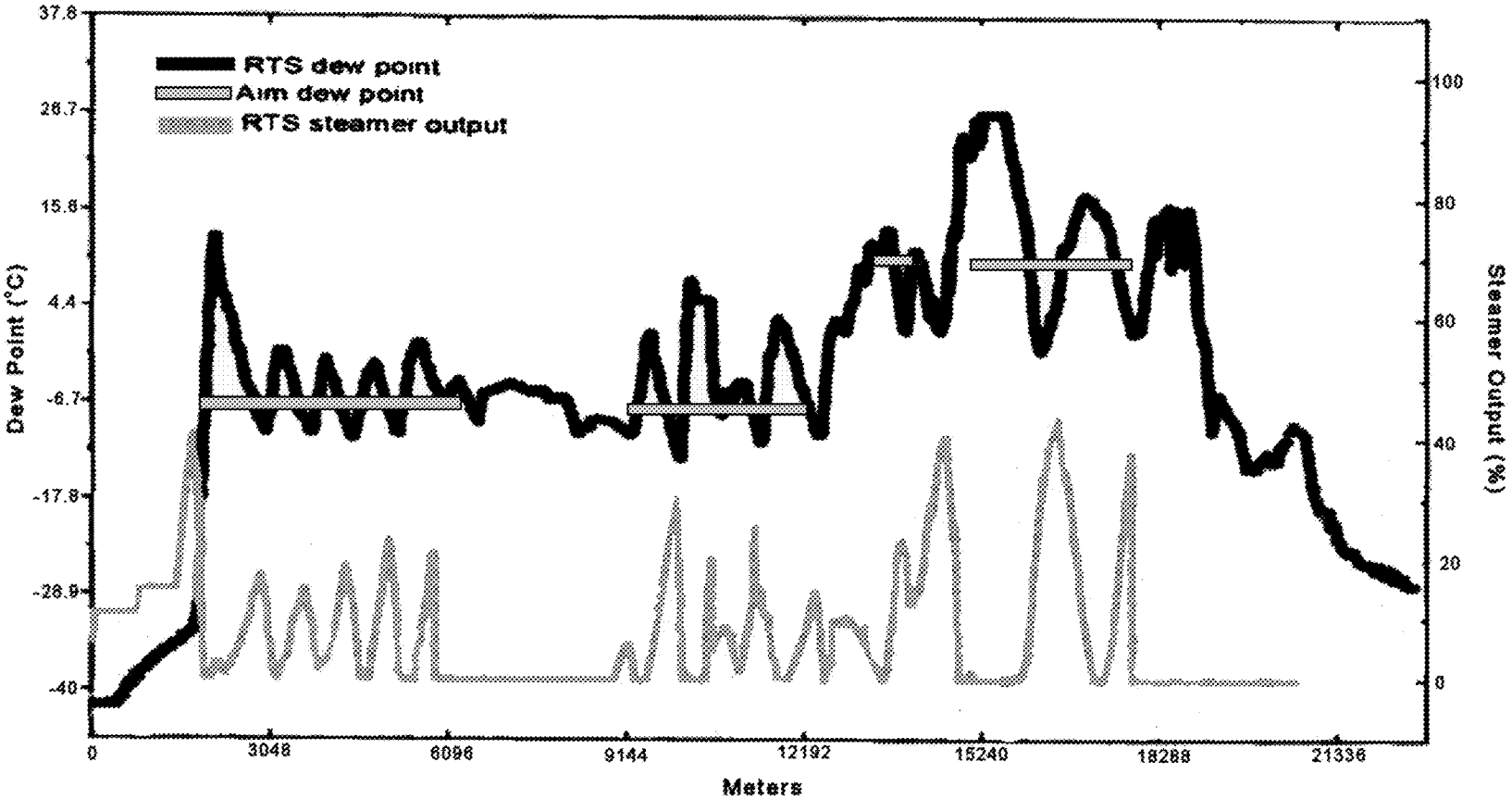
FIG. 3 is a plot of the dew point and steam generator output vs time for the prior art control system.
Figure 4:
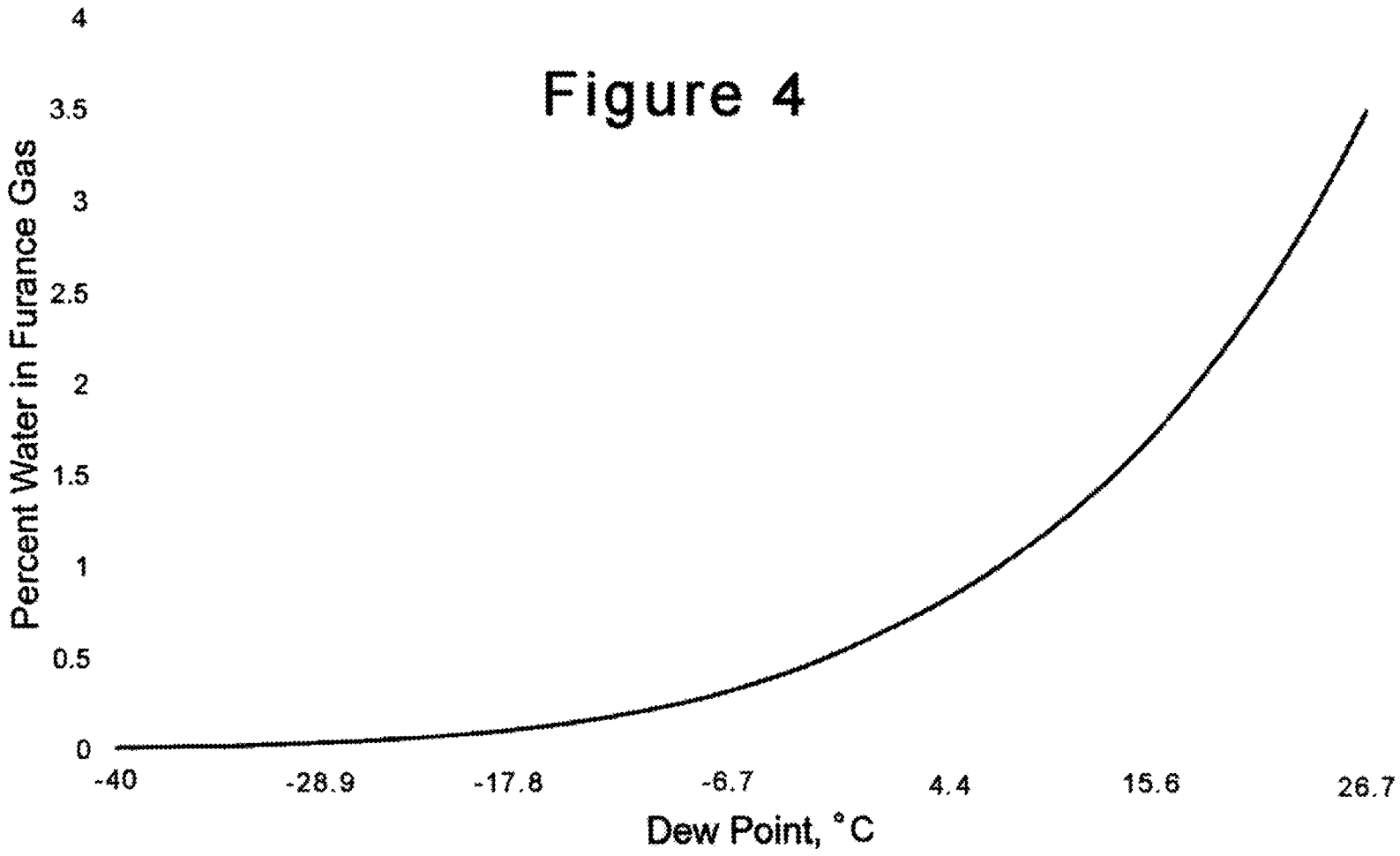
FIG. 4 plots the relationship between dew point in ° C. and percent water in the furnace gas.
Figure 5:
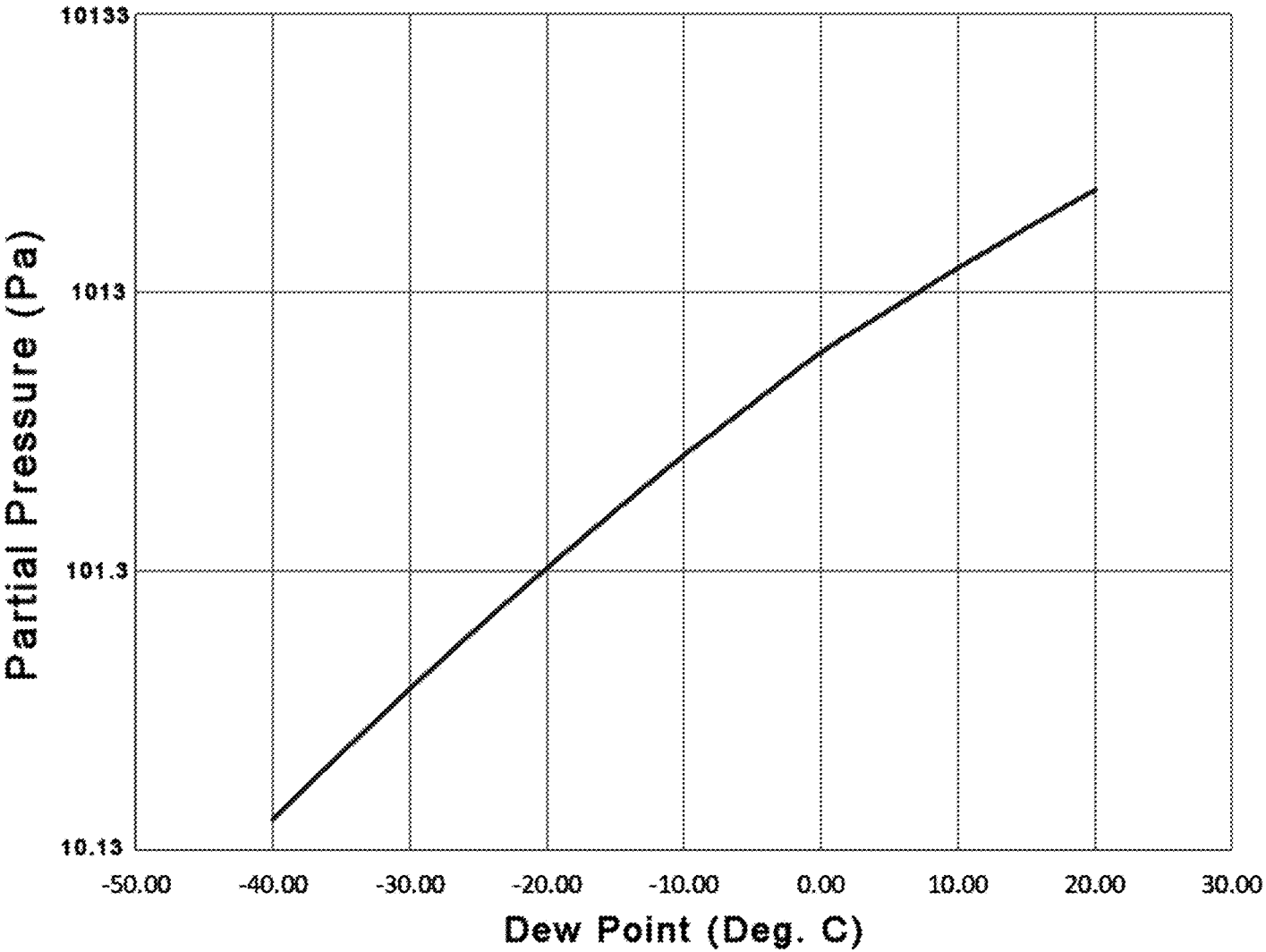
FIG. 5 plots the relationship between partial pressure of water in Pa and the dew point in ° C.

In evaluating the limitations and flaws of the prior art furnace and control structure, the present inventors noted that the relationship between the dew point and the water concentration in the atmosphere is highly nonlinear. FIG. 4 plots the relationship between dew point in ° C. and percent water in the furnace gas. As can be seen, the relationship is highly non-linear, making the task of controlling the dew point very difficult. The inventors also noted that the relationship between dew point and partial pressure of water is relatively linear. FIG. 5 plots the relationship between partial pressure of water in Pa and the dew point in ° C. Therefore, the present inventors added a step to the control system wherein all dew point set points and dew point measurements are converted to partial pressures when input to the control structure.

The inventors also noted that the mixing time for water input to the furnace until the dew point sensor actually sensed the water is quite large. This again makes control of the dew point very difficult because of the large time lag between water input and sensor measurement. To help combat this, the inventors added a second dew point sensor closer to the steam injection point.

Finally, the inventors added an addition PID controller in cascade with the original one to improve control of the dew point.

Figure 6:
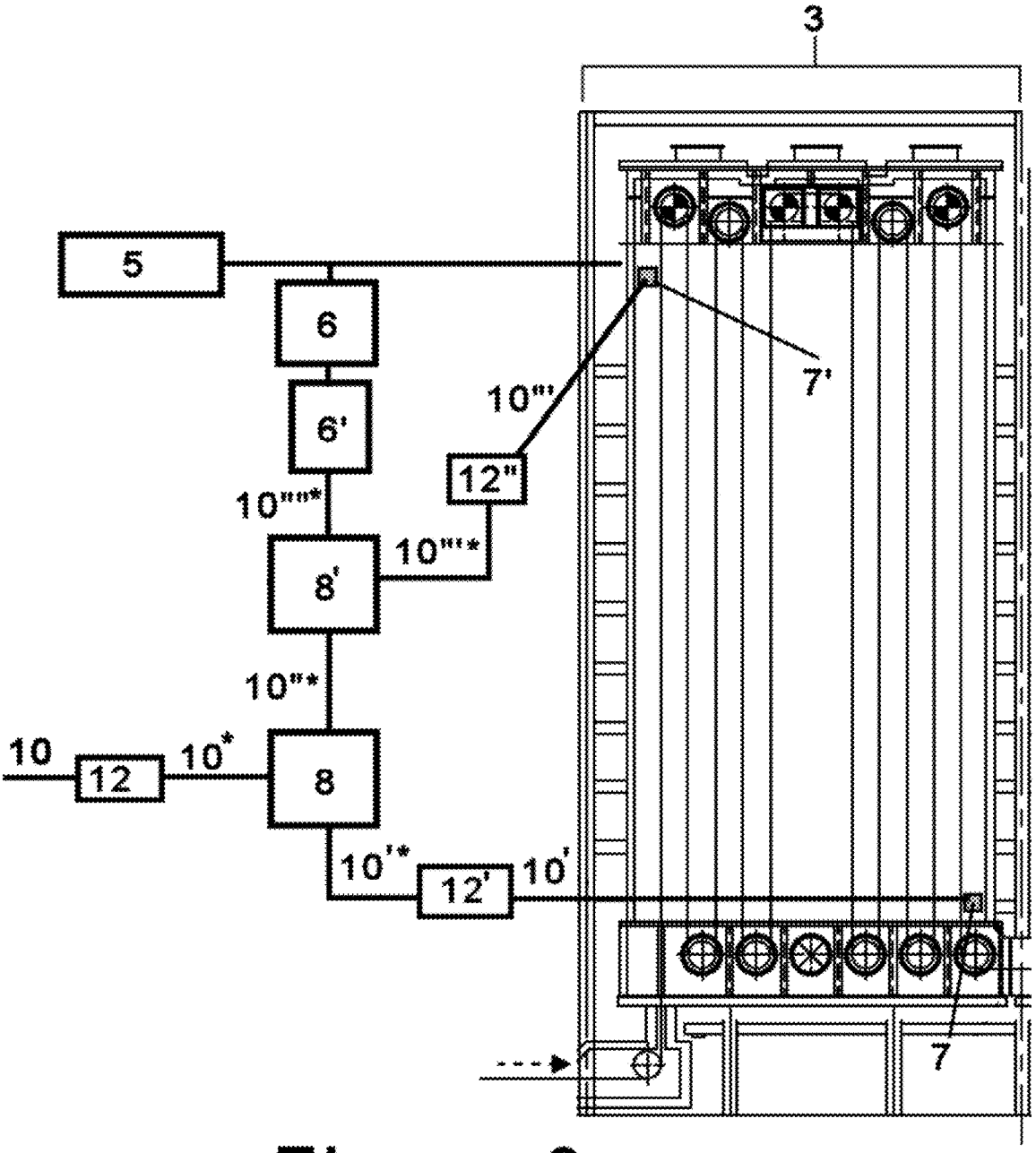
FIG. 6 is a schematic depiction of the inventive furnace with control structure.

FIG. 6 depicts a furnace with the new control structure. While only one furnace (RTH 3) is depicted, the same control structure was implemented for both the RTH 3 and the RTS 4. The new control structure retains the original dew point sensor 7 and the bottom of the furnace, and adds a new dew point sensor 7' at the top of the furnace near the steam injection point. The control structure also includes dew point converters 12, 12' and 12" to convert the set dew point, and measured dew points into partial pressures of steam. Thus, the convertor 12 converts the set point dew point signal 10 into a set point partial pressure of water 10*. The convertor 12' converts the measured dew point signal 10' from the lower dew point sensor 7 into a partial pressure of steam 10'*. Finally, convertor 12" converts the measured dew point signal 10''' from the upper dew point sensor 7' into a partial pressure of steam 10'''*.

The equations for conversion of dew point in ° C. to partial pressure of water in atmospheres is given by the following equations:

$$P = 10^{min\left(6.28-\frac{2320}{dp+273.15},7.54\frac{2665}{dp+273.15}\right)}$$

$$dp = \max(2320/(6.28-\log_{10}P),$$

$$2665/(7.54-\log_{10}P))-273.15$$

It should be noted that the conversion from atmospheres to Pa is 1 atm=101325 Pa.

The inventive control system now includes two PID controllers forming a cascaded control. The set point signal after conversion to partial pressure of steam 10* is input to the outer loop PID controller 8 this is compared with the measured dew point signal 10' from the lower dew point sensor 7, which has been converted to a partial pressure of steam 10'*. Outer loop PID controller 8 uses the two signals 10* and 10'* to create an error signal which is added to the set point signal 10* to produce an input signal 10"* to the inner loop PID controller 8'.

This input signal 10"* is compared with the measured dew point signal 10''' from the upper dew point sensor 7', which has been converted to a partial pressure of steam 10'''*. Inner loop PID controller 8' uses the two signals 10"* and 10'''* to create an error signal which is added to the input signal 10"* to produce an output signal 10'''* to the steam generator controller 6' which adjusts the output of the steam generator 6.

Figure 7:
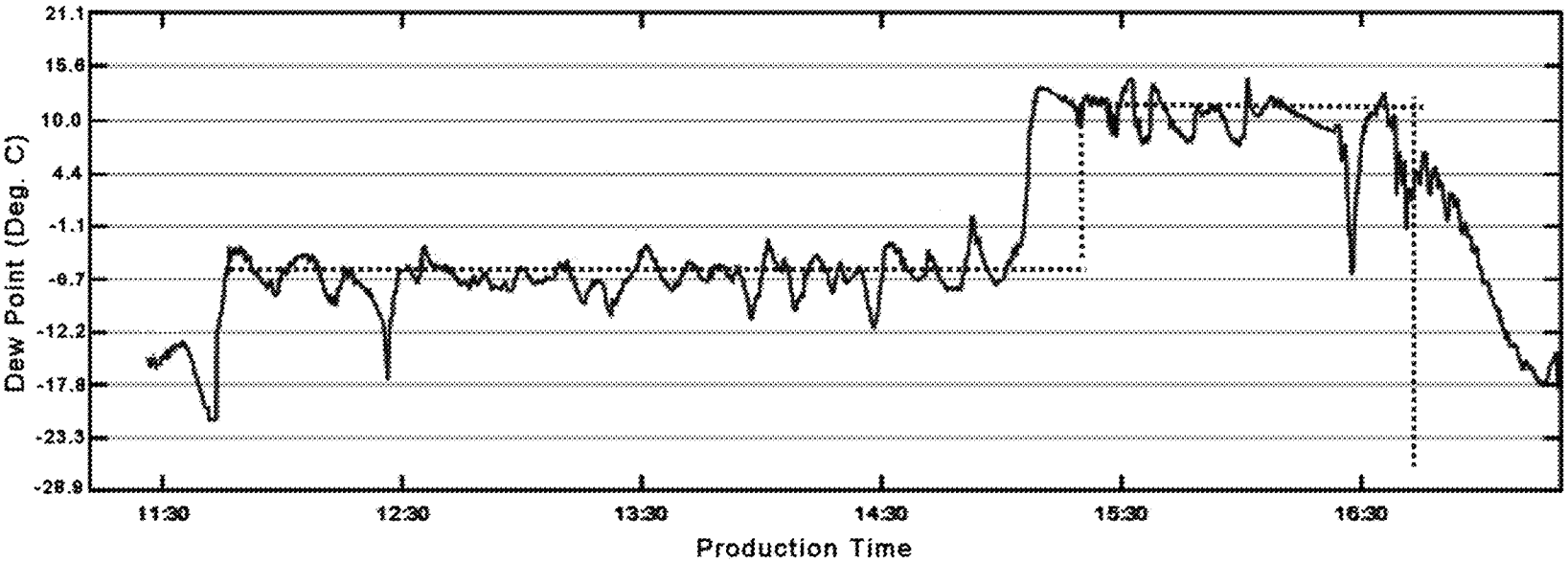
FIG. 7 plots the dew point of the RTS furnace using the inventive control structure versus production time for a number of steel coils.

These improvements to the control structure of the furnace results in a significant improvement in the dew point control within the furnace. FIG. 7 plots the dew point of the RTS furnace using the inventive control structure versus production time for a number of steel coils and includes a set point change. As can be seen, the dew point control of the furnace is significantly improved and is good enough for continuous production.

Figure 8:
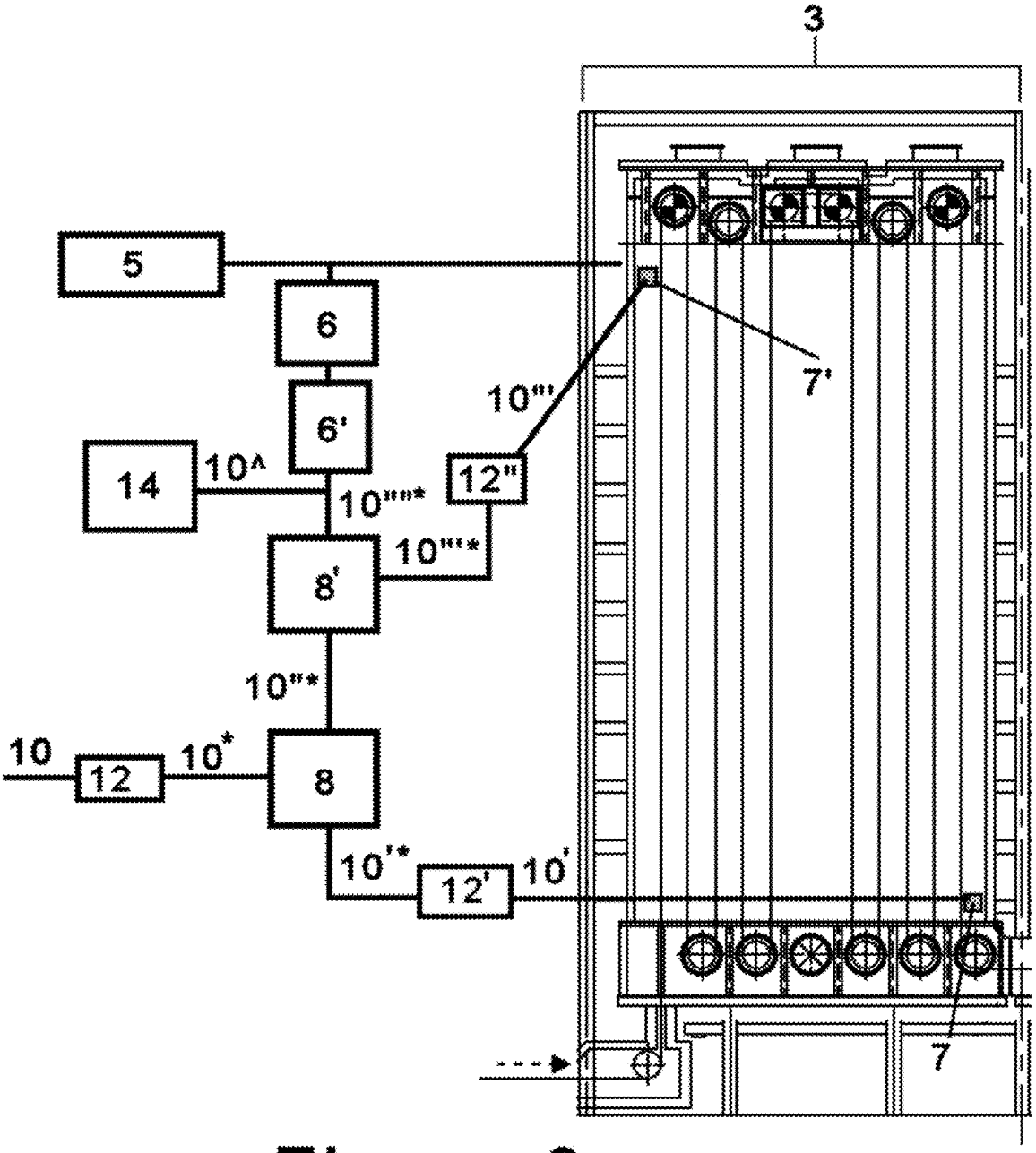
FIG. 8 is a schematic depiction of the inventive furnace/control system which includes a feed forward module.

The inventors have further contemplated the possible need for a feed forward mechanism to the control structure. The feed forward signal would be generated based on the type of steel being processed (i.e. the carbon content thereof, reactivity with water vapor, etc.), expected line speed changes, steel strip width changes and atmospheric changes to the system. FIG. 8 is a depiction of a furnace/control system which includes a feed forward module 14. A feed forward signal 10ˆ would be mathematically created based on these factors and it would be combined with the output signal 10""* of the cascade control system to preemptively adjust the signal to the steam generator controller 6' and ultimately to the steam generator 6. The feed forward signal 10ˆ may increase or decrease the amount of steam being injected into the furnace by the steam generator 6, depending on what the upcoming change involves.

If the steamer output (controlled ultimately by the inner loop PID 8') is lower than 4% or higher than 100% (i.e. outside the physical limits of the steam generator 6), there is internal logic which prevents the integrator from windup. That same logical needs to be sent to the outer loop PID to place that integrator into a hold state to prevent windup.

The control system may also include dry out logic. This Logic will flood both the RTH and RTS furnaces with HNx (pure atmosphere with no added steam) should the steamer output be less than the threshold for steam injection and the error is such that there is too much water in the furnace. This is used when furnace dew point is very high and the steamer is at its lowest setting. Flooding the furnace with dry atmospheric gas from the atmospheric gas supply 5 will flush out the excess moisture very quickly. Once the excess moisture has been flushed from the furnace, the steam generator 6 can bring the furnace back to the proper desired dew point.

We claim:

1. A steel strip annealing furnace with a dew point control system, the furnace including:

a furnace having an upper region and a lower region;

a furnace atmosphere injector configured to inject furnace atmospheric gases into an injection region in the upper region of the furnace;

a steam generator coupled with the atmosphere injection system to mix steam into the furnace atmospheric gases;

a control system for controlling the steam generator to provide a desired dew point within the furnace; the control system including an input dew point (DP) set point signal generator generating a DP set point signal corresponding to a desired furnace DP;

the control system further including two DP sensors measuring a local dew point and transmitting a signal representative of the measured local dew point; one of the DP sensors being an upper DP sensor positioned in the upper region of the furnace and adjacent the injection region; the other of the DP sensors being a lower DP sensor positioned in the lower region of the furnace, remote from the injection region;

the control system further including two proportional-integral-derivative (PID) controllers configured in a cascaded loop configuration;

the control system further including three signal convertors (SC), each SC designed to receive a DP input signal and convert the DP input signal into a partial pressure of steam (PPS) output signal;

a lower of the PID controllers being connected to a first SC of the SCs, the first SC having an input DP set point signal from the DP set point signal generator, and an output PPS set point signal transmitted to the lower PID controller;

the lower PID controller also connected to a second SC of the SCs, the second SC having an input lower feedback DP signal from the lower DP sensor and an output lower feedback PPS signal transmitted to the lower PID controller;

the lower PID controller comparing the PPS set point signal and the lower feedback PPS signal and generating a lower PID error value; the lower PID error value being added to the PPS set point signal to generate a lower PID output PPS signal;

the lower PID controller connected to the upper PID controller, the lower PID controller transmitting the lower PID output PPS signal to the upper PID controller, the lower PID output PPS signal becoming an upper input PPS set point signal for the upper PID controller;

the upper PID controller also connected to a third SC of the SCs, the third SC having an input upper feedback DP signal from the upper DP sensor and an output upper feedback PPS signal transmitted to the upper PID controller;

the upper PID controller comparing the upper input PPS set point signal to the upper feedback PPS signal and generating an upper PID error value added to the upper input PPS set point signal to generate an upper PID output signal;

the upper PID controller connected to a steam generator controller; the upper PID controller transmitting the upper PID output signal to the steam generator controller thereby controlling the injection of steam into the furnace.

2. The annealing furnace with dew point control system as recited in claim 1 wherein the control system further includes a feed forward control unit.

3. The annealing furnace with dew point control system as recited in claim 2 wherein the feed forward control unit calculates a signal to be added to the upper PID output signal.

4. The annealing furnace with dew point control system as recited in claim 3 wherein the signal to be added to said upper PID output signal is calculated based on known upcoming changes in a steel grade or chemistry, line speed, and steel strip width.

* * * * *